US008333378B2

(12) United States Patent
Miyazaki et al.

(10) Patent No.: US 8,333,378 B2
(45) Date of Patent: Dec. 18, 2012

(54) DISCHARGE MECHANISM AND IMAGE-FORMING DEVICE

(75) Inventors: Megumi Miyazaki, Yokohama (JP); Yukihiro Ichiki, Yokohama (JP); Motoyuki Yagi, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/169,707

(22) Filed: Jun. 27, 2011

(65) Prior Publication Data

US 2012/0098192 A1 Apr. 26, 2012

(30) Foreign Application Priority Data

Oct. 25, 2010 (JP) ..... 2010-239066

(51) Int. Cl.
*B65H 29/20* (2006.01)

(52) U.S. Cl. ..... 271/314; 271/188

(58) Field of Classification Search ..... 271/314, 271/207, 188
See application file for complete search history.

(56) References Cited

U.S. PATENT DOCUMENTS

| | | | | |
|---|---|---|---|---|
| 5,215,394 | A * | 6/1993 | Kim | 400/625 |
| 7,513,498 | B2 * | 4/2009 | Elenes et al. | 271/178 |
| 8,118,506 | B2 * | 2/2012 | Bridges et al. | 400/634 |
| 2005/0179193 | A1 * | 8/2005 | Elenes | 271/119 |
| 2007/0201892 | A1 | 8/2007 | Ando et al. | |
| 2009/0257768 | A1 | 10/2009 | Ando et al. | |
| 2009/0295084 | A1 * | 12/2009 | Numao | 271/314 |
| 2010/0232856 | A1 * | 9/2010 | Tanaka | 399/405 |

FOREIGN PATENT DOCUMENTS

| | | | |
|---|---|---|---|
| JP | 2007-126265 | A | 5/2007 |
| JP | 2007-223774 | A | 9/2007 |

* cited by examiner

*Primary Examiner* — David H Bollinger
(74) *Attorney, Agent, or Firm* — Sughrue Mion, PLLC

(57) ABSTRACT

A discharge mechanism includes: a rotation shaft; a pair of roll members disposed on the rotation shaft at different positions in an axial direction; and a protrusion that protrudes from a section of the rotation shaft sandwiched between the pair of roll members, wherein a distance from a center of the rotation shaft to a tip of the protrusion is smaller than a radius of each of the pair of roll members, and the protrusion includes a projecting part that projects in a direction of rotation of the rotation shaft.

7 Claims, 8 Drawing Sheets

DISCHARGE MECHANISM AND IMAGE-FORMING DEVICE

CROSS-REFERENCE TO RELATED APPLICATIONS

This application is based on and claims priority under 35 U.S.C. 119 from Japanese Patent Application No. 2010-239066, which was filed on Oct. 25, 2010.

BACKGROUND

1. Technical Field

The present invention relates to a discharge mechanism and an image-forming device.

2. Related Art

Various technologies are being developed to improve a process of discharging a recording medium from an image-forming device.

SUMMARY

In one aspect of the present invention, there is provided a discharge mechanism including: a rotation shaft; a pair of roll members disposed on the rotation shaft at different positions in an axial direction; and a protrusion that protrudes from a section of the rotation shaft sandwiched between the pair of roll members, wherein a distance from a center of the rotation shaft to a tip of the protrusion is smaller than a radius of each of the pair of roll members, and the protrusion includes a projecting part that projects in a direction of rotation of the rotation shaft.

BRIEF DESCRIPTION OF THE DRAWINGS

Exemplary embodiments of the present invention will now be described in detail with reference to the following figures, wherein.

DETAILED DESCRIPTION

1. Exemplary Embodiment 1-1. Overall Configuration

In this exemplary embodiment, a recording medium refers to a sheet-like member on which an image is to be formed by image-forming unit 500. A recording medium typically is a sheet of paper or an envelope made of paper, but it may be a sheet of plastic.

In the following description and drawings, directions will be indicated using X-axis, Y-axis, and Z-axis, which intersect perpendicularly to one another. The coordinate system represented by X-axis, Y-axis, and Z-axis is a right-handed one. A direction in which an X component (a component represented on X-axis) increases along X-axis will be referred to as X(+) direction, while a direction in which an x component decreases along X-axis will be referred to as X(−) direction. The same applies in the case of each of a Y component and a Z component.

Figure 1:
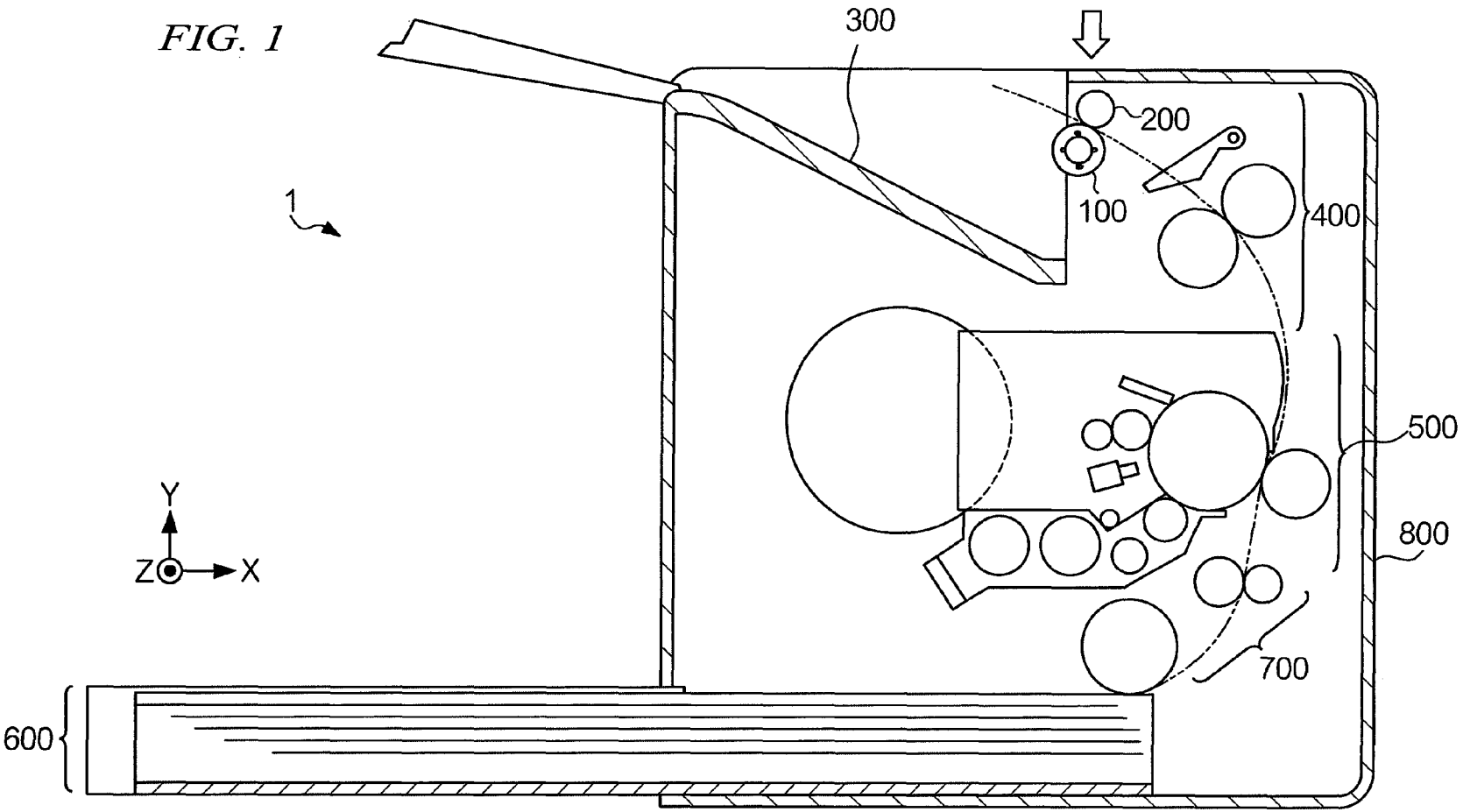
FIG. 1 is a drawing for explaining an overall configuration of an image-forming device according to an exemplary embodiment of the present invention.

FIG. 1 is a drawing for explaining an overall configuration of image-forming device 1 according to an exemplary embodiment of the present invention. FIG. 1 is a schematic diagram of an inside of image-forming device 1 as viewed in Z(−) direction.

Supply unit 600 includes a container for containing recording media such as a sheet of paper or an envelope. When the container is set in housing 800, the recording media contained in the container become ready for supply.

Conveying unit 700 takes out the recording media from supply unit 600 one sheet at a time, and conveys the recording media to image-forming unit 500.

Image-forming unit 500 forms an image on a surface of a recording medium by an electrophotography process using a developer. Specifically, image-forming unit 500 includes a photosensitive member that holds a latent image, an exposure device that exposes the photosensitive member to cause the photosensitive member to hold a latent image, a developer supply device that supplies a developer to the latent image held by the photosensitive member, and a transfer device that transfers a developed image from the photosensitive member to the recording medium. The developer may contain black toner, for example.

Fixing unit 400 heats the toner that has been caused to adhere to the surface of the recording medium by image-forming unit 500, so that the toner melts and an image is fixed on the recording medium.

Discharge unit 100 catches the recording medium, on which an image has been fixed by fixing unit 400, in cooperation with assist unit 200, and discharges the recording medium onto stacking unit 300.

Stacking unit 300 stacks and holds recording media discharged from discharge unit 100.

1-2. Configuration of Discharge Unit

Figure 2:
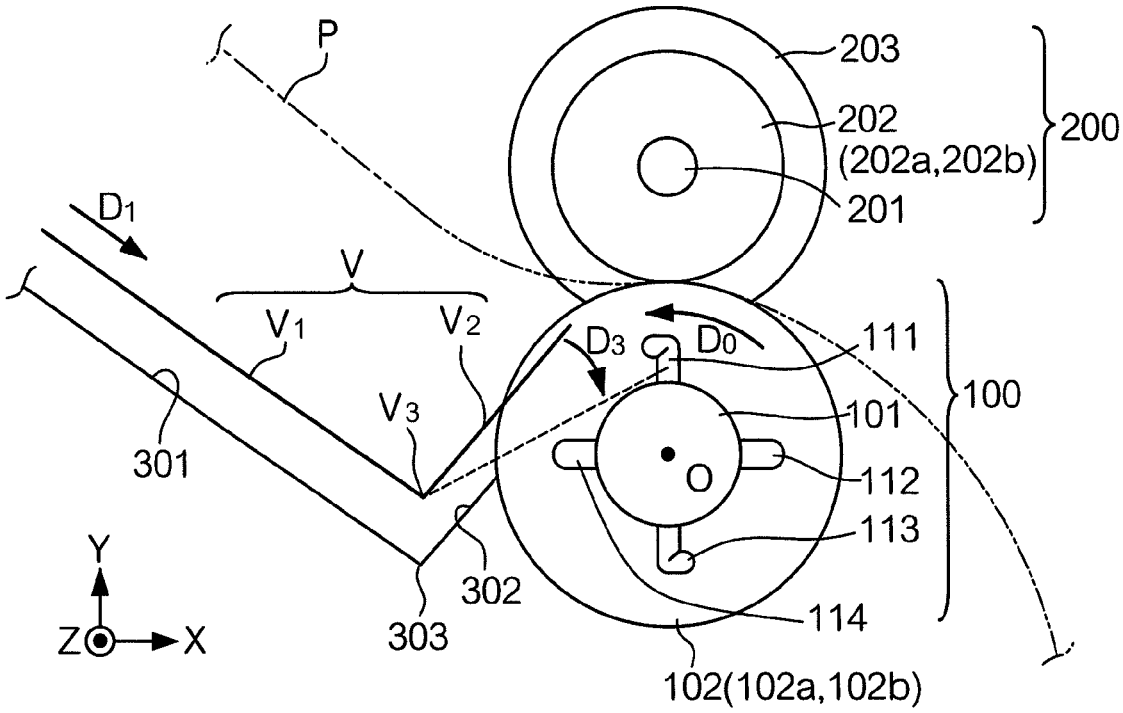
FIG. 2 is a drawing showing a configuration of a discharge unit and its surroundings.

FIG. 2 is a drawing showing a configuration of discharge unit 100 and its surroundings. This drawing is a schematic diagram as viewed in Z(−) direction.

Discharge unit 100 includes discharge rod 101, discharge rollers 102, first protrusions 111, second protrusions 112, third protrusions 113, and fourth protrusion 114. Discharge rod 101 is a rod-shaped member having axis O at its center, and is caused to rotate about axis O by a drive unit (not shown). On a circumference of discharge rod 101 are provided a pair of discharge rollers 102*a* and 102*b*, which are spaced apart from each other in an axial direction (in the following description, where it is not necessary to distinguish these rollers, they will be simply referred to as "discharge rollers 102"), first protrusions 111, second protrusions 112, third protrusions 113, and fourth protrusion 114.

Discharge rollers 102 each are a member whose cross-sectional view taken perpendicularly to discharge rod 101 is a circle with its center coinciding with axis O. Discharge rollers 102, which are provided on discharge rod 101, catch a recording medium in cooperation with assist roller 202 of assist unit 200, which will be described later, and are caused to rotate about axis O of discharge rod 101 in a direction of arrow D0 to discharge the recording medium onto stacking unit 300.

Each of first protrusions 111, second protrusions 112, third protrusions 113, and fourth protrusion 114 (in the following description, summarily referred to as "protrusions") is provided in a section of discharge rod 101 sandwiched between discharge rollers 102*a* and 102*b*. Therefore, these protrusions are caused to rotate about axis O together with rotation of discharge rod 101.

A distance from axis O of discharge rod 101 to a tip of each protrusion is smaller than a radius of discharge roller 102 (more precisely, a radius of a circle represented by a cross-section of discharge roller 102 taken along a plane perpendicular to axis O). In other words, rotation of an outer end of each of these protrusions describes a circle whose radius is smaller than the radius of discharge roller 102.

Assist unit 200 includes assist rod 201, assist rollers 202, and guide roller 203. Guide roller 203 is a roller rotating around assist rod 201, and determines a position of assist rod 201 relative to discharge rod 101 when a circumferential surface of guide roller 203 abuts a plate-like member (not shown) provided on housing 800.

Assist rollers 202*a* and 202*b* (in the following description, where it is not necessary to distinguish these rollers, they will be simply referred to as "assist rollers 202") are rollers rotating around assist rod 201, and are provided at positions on assist rod 201 opposed to discharge rollers 102*a* and 102*b*. A diameter of each assist roller 202 is larger than that of assist rod 201. Since the distance between assist rod 201 and discharge rod 101 is determined by guide roller 203, a clearance between discharge rollers 102 and assist rollers 202 is also adjusted. Assist rollers 202 operate following an operation of discharge rollers 102, to catch a recording medium in cooperation with opposed discharge rollers 102 and discharge the recording medium onto stacking unit 300. Path P indicated by a long- and double-short dashed line is a path of a recording medium conveyed by discharge rollers 102 and assist rollers 202.

Stacking unit 300 includes a plate member bent at edge 303 to form bottom portion 301 and side portion 302. The recording media caught and discharged by discharge rollers 102 and assist rollers 202 are stacked on bottom portion 301. Since bottom portion 301 is inclined with respect to a direction of gravity (Y(−) direction), the recording media stacked on bottom portion 301 tend to slide down in a direction of arrow D1. Side portion 302 abuts ends of the recording media to block sliding down of the recording media in the direction of arrow D1.

Now, an explanation will be given of envelope V serving as a recording medium that is caught and discharged by discharge rollers 102 and assist rollers 202 along path P. Envelope V is contained in supply unit 600 in an open state, and after an image including characters representing a name of an addressee, a destination address, and the like, is formed on a front side, for example, envelope V is discharged by discharge unit 100.

Figure 3:
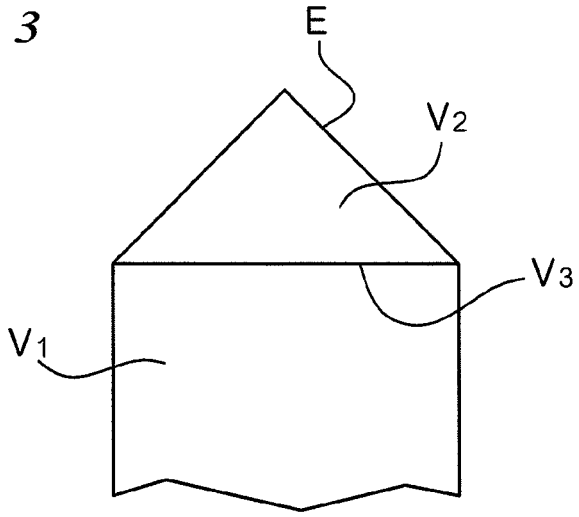
FIG. 3 is a drawing showing an envelope.

FIG. 3 is a drawing showing a configuration of envelope V. Envelope V is divided into envelope main body V1 and closure portion V2, which is also referred to as a "flap," by folding line V3. Envelope V is closed when flap V2 is folded along folding line V3 and is glued to envelope main body V1. The shape of flap V2 shown in FIG. 3 is a triangle (isosceles triangle) including folding line V3 as a base.

When envelope V is discharged by discharge unit 100, envelope V is in an open state, and thus, flap V2 is not folded along folding line V3 to be in contact with or to be close to envelope main body V1. It should be noted, however, that in a case where there is a crease along folding line V3 so that envelope V tends to be folded in a convex shape in a downward direction (Y(−) direction), envelope V may be held in stacking unit 300 in a state in which it is folded along folding line V3 as shown in FIG. 2. In this state, envelope V is held with envelope main body V1 extending along bottom portion 301, while flap V2 extends along side portion 302.

Figure 4:
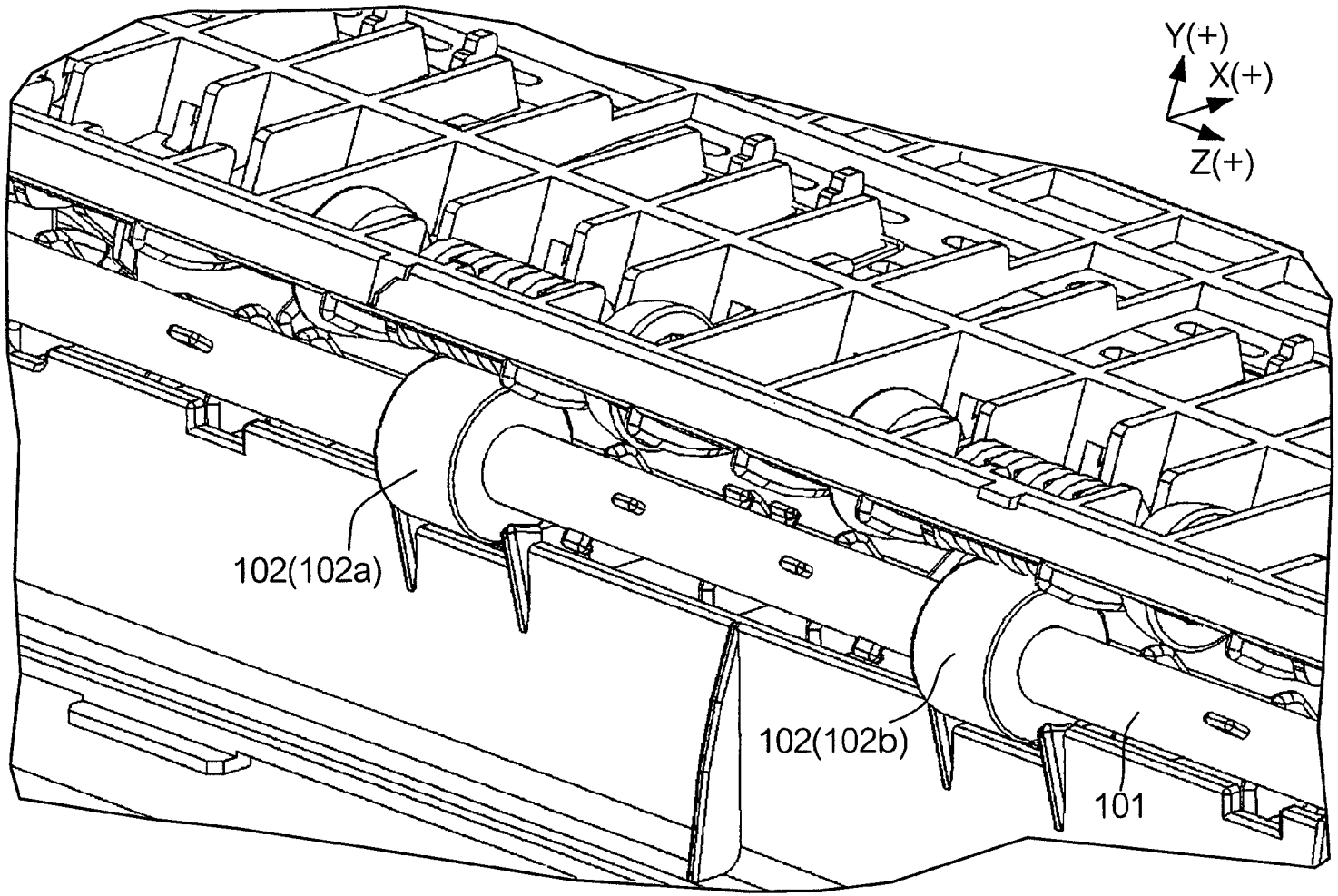
FIG. 4 is a perspective view showing a configuration of a discharge unit and its surroundings.

1-3. Configuration of Protrusions 1-3-1. Arrangement of Protrusions in Direction of Rotation FIG. 4 is a perspective view showing a configuration of discharge unit 100 and its surroundings. As shown in this drawing, discharge rod 101 extends along Z-axis, and two discharge rollers 102*a* and 102*b* are provided such that they are spaced apart from each other by a predetermined distance in an axial direction of discharge rod 101 (Z-axis direction). Discharge roller 102*a* is positioned on a side in a Z(−) direction with respect to discharge roller 102*b*.

Figure 5:
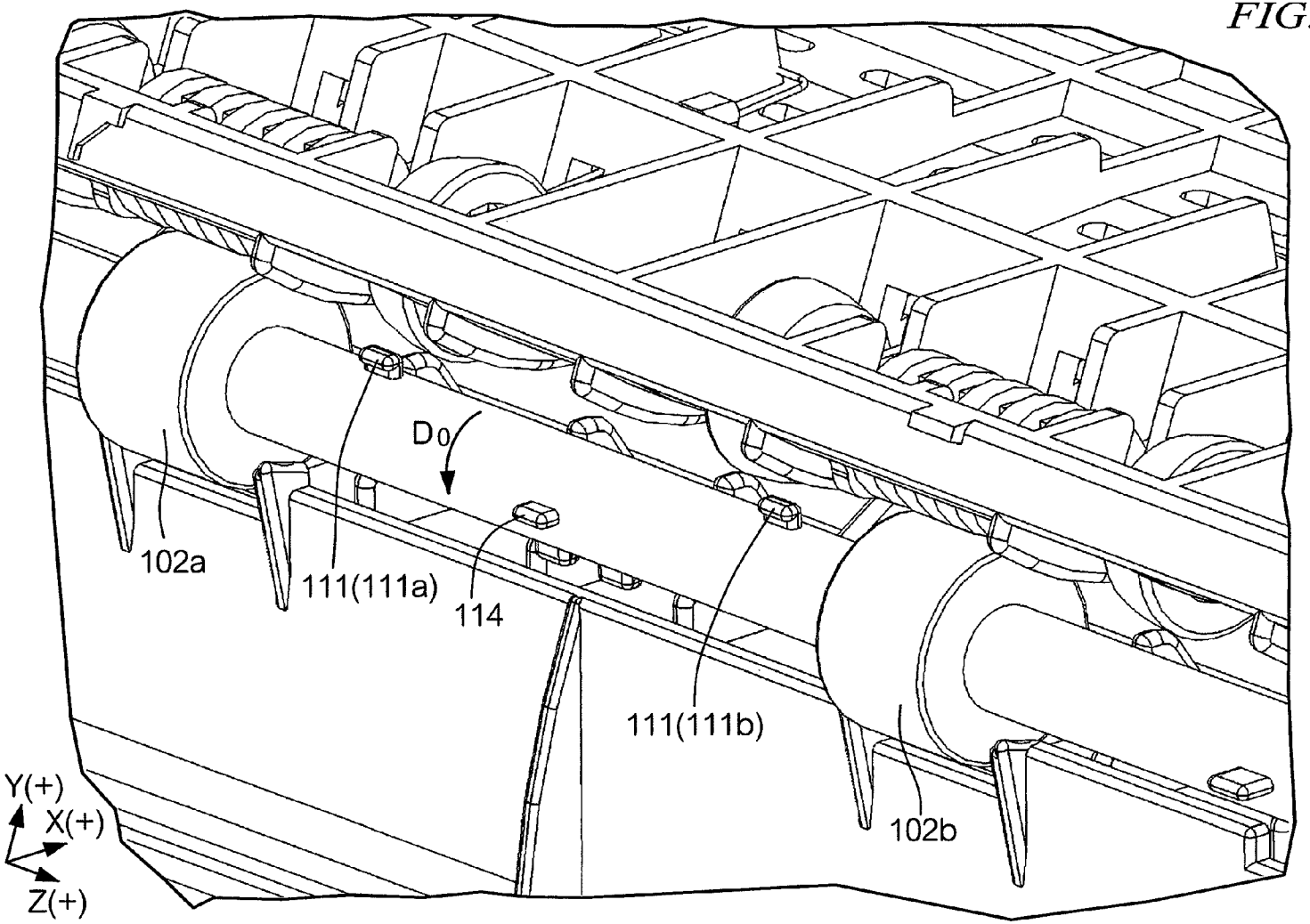
FIG. 5 is a drawing showing an enlarged view of a section of a discharge rod sandwiched between discharge rollers.

FIG. 5 is a drawing showing an enlarged view of a section of discharge rod 101 sandwiched between discharge rollers 102*a* and 102*b*. As shown in this drawing, fourth protrusion 114 is provided at a center of this section in the axial direction (Z-axis direction). Discharge rod 101 is caused to rotate in the direction of arrow D0, and with respect to this direction of rotation, at a position spaced in a rearward direction from fourth protrusion 114 by one quarter of a turn (90 degrees) are provided first protrusions 111*a* and 111*b* (in the following description, where it is not necessary to distinguish these protrusions, they will be simply referred to as "first protrusions 111"). First protrusion 111*a* is positioned on a side in a Z(−) direction with respect to first protrusion 111*b*.

Figure 6:
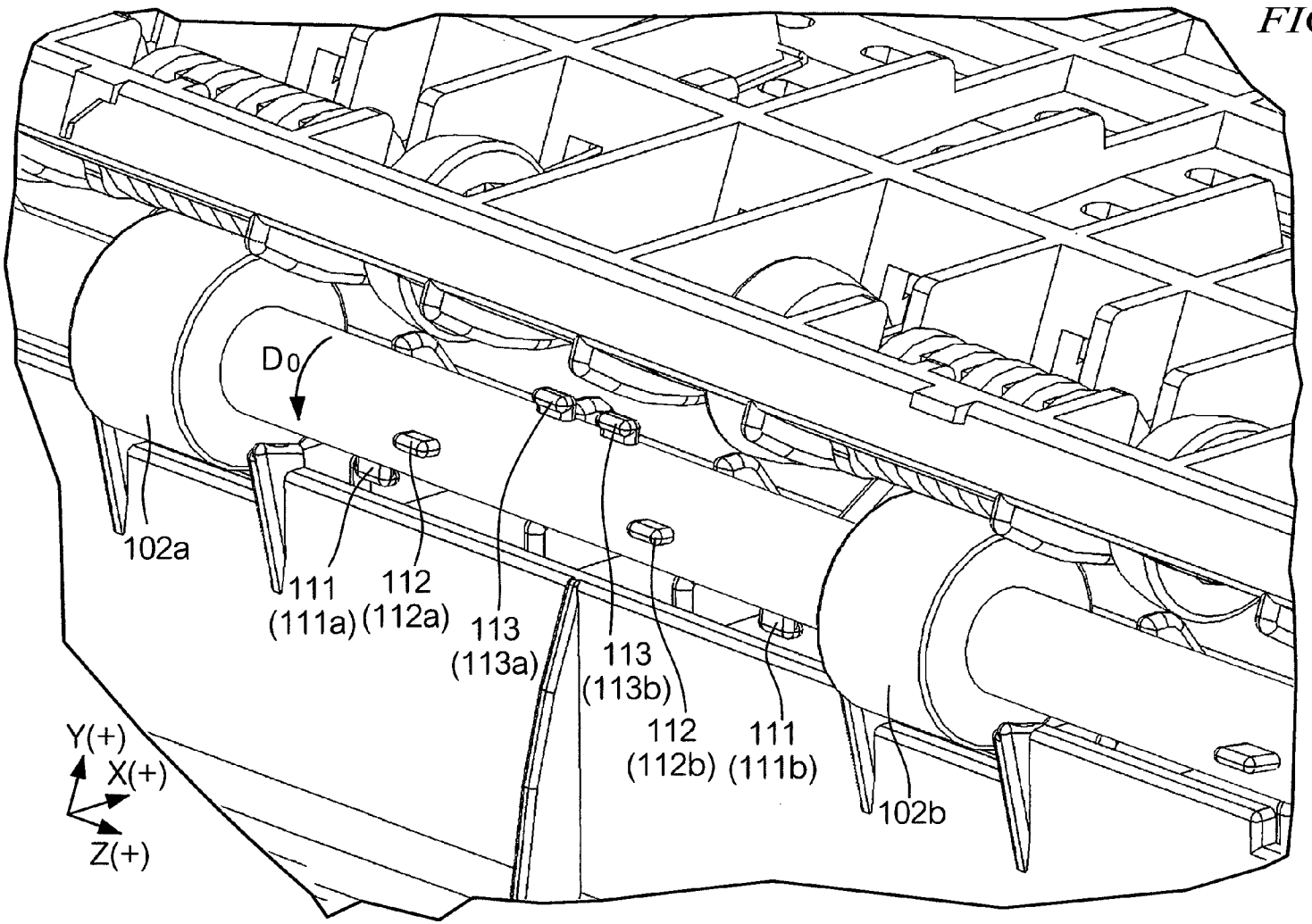
FIG. 6 is another drawing showing an enlarged view of a section of a discharge rod sandwiched between discharge rollers.

FIG. 6 is another drawing showing an enlarged view of a section of discharge rod 101 sandwiched between discharge rollers 102*a* and 102*b*, where discharge rod 101 has been rotated by a half turn (180 degrees) from the state shown in FIG. 5. With respect to the direction of rotation indicated by arrow D0, at a position spaced in a rearward direction from first protrusions 111 by one quarter of a turn (90 degrees) are provided second protrusions 112*a* and 112*b* (in the following description, where it is not necessary to distinguish these protrusions, they will be simply referred to as "second protrusions 112"). Second protrusion 112*a* is positioned on a side in a Z(−) direction with respect to second protrusion 112*b*.

Also, with respect to the direction of rotation, at a position spaced in a rearward direction from second protrusions 112 by one quarter of a turn (90 degrees) are provided third protrusions 113*a* and 113*b* (in the following description, where it is not necessary to distinguish these protrusions, they will be simply referred to as "third protrusions 113"). Third protrusion 113*a* is positioned on side in a Z(−) direction with respect to third protrusion 113*b*.

Further, with respect to the direction of rotation, at a position spaced in a rearward direction from third protrusions 113 by one quarter of a turn (90 degrees) is provided fourth protrusion 114. Namely, in a rearward direction with respect to the direction of rotation of discharge rod 101, first protrusions 111, second protrusions 112, third protrusions 113, and fourth protrusion 114 are arranged in the order stated, spaced apart from one another at an angular interval of one quarter of a turn (90 degrees). In other words, in a section of discharge rod 101 sandwiched between discharge rollers 102*a* and 102*b*, respective types of protrusions are provided at four different positions in the direction of rotation of discharge rod 101.

At least one of the four types of protrusions is provided with a hook portion. A hook portion is a portion projecting in the direction of rotation from a tip portion of a protrusion (i.e., an outer end portion of a protrusion from discharge rod 101). In this exemplary embodiment, first protrusions 111 and third protrusions 113 each are provided with a hook portion, while second protrusions 112 and fourth protrusion 114 are not. Detailed explanation of the hook portion will be given later.

1-3-2. Arrangement of Protrusions in Axial Direction

Figure 7:
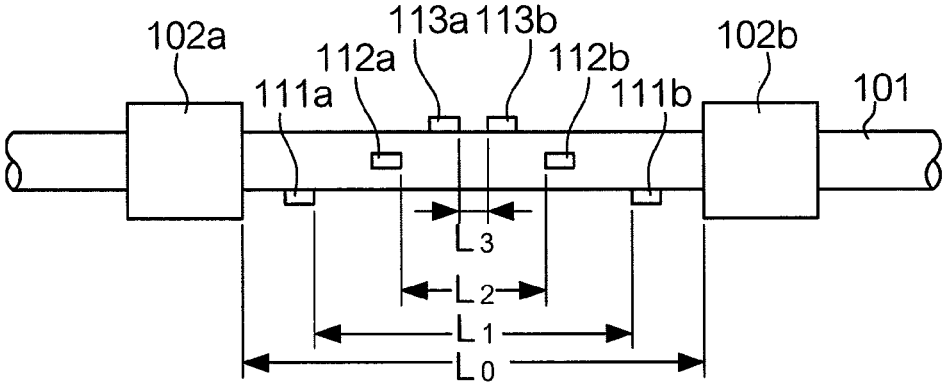
FIG. 7 is a drawing showing an arrangement of protrusions in an axial direction.

FIG. 7 is a drawing showing an arrangement of protrusions in an axial direction (Z-axis direction). The length of the section of discharge rod 101 sandwiched between discharge rollers 102*a* and 102*b*, i.e., the length from a surface of discharge roller 102*a* on a Z(+) side to a surface of discharge roller 102*b* on a Z(−) side is length L0. The length from a surface of first protrusion 111*a* on a Z(+) side to a surface of first protrusion 111*b* on a Z(−) side is length L1. The length from a surface of second protrusion 112*a* on a Z(+) side to a surface of second protrusion 112*b* on a Z(−) side is length L2. The length from a surface of third protrusion 113*a* on a Z(+) side to a surface of third protrusion 113*b* on a Z(−) side is length L3. There is a relationship between L0, L1, L2, and L3, that is, L0>L1>L2>L3.

Figure 8:
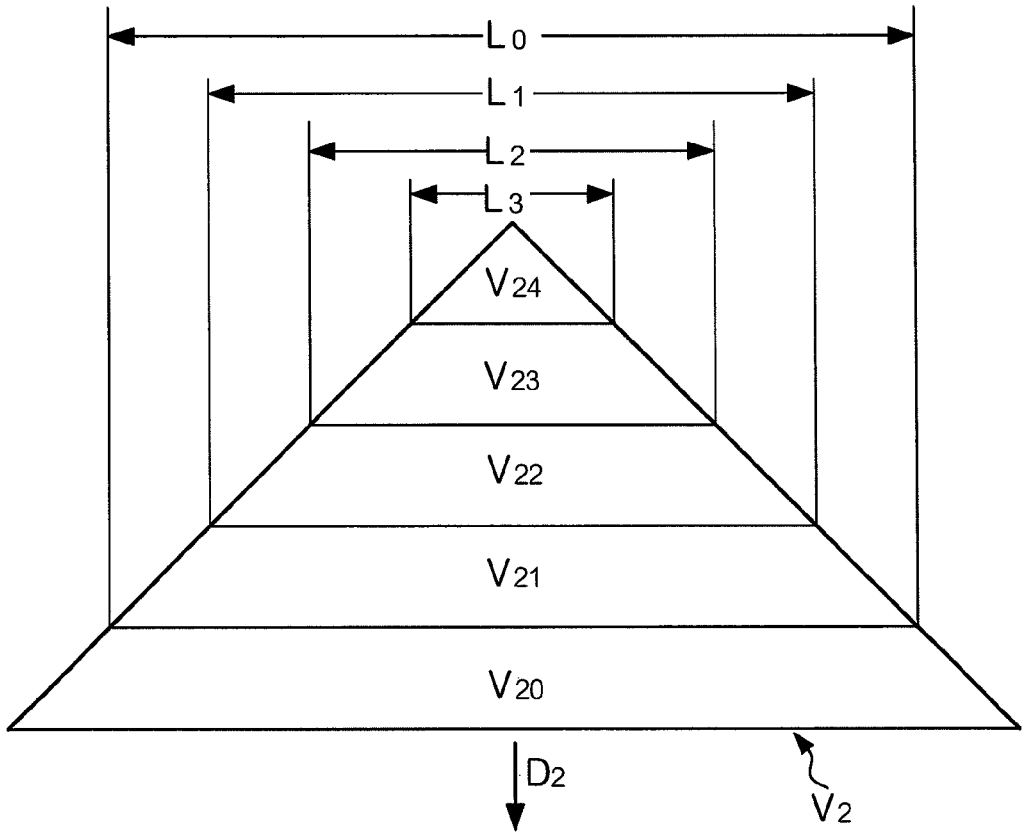
FIG. 8 is a drawing showing an axial distance between a pair of discharge rollers and an axial distance between each pair of protrusions in relation to a flap of an envelope.

FIG. 8 is a drawing showing an axial distance between a pair of discharge rollers 102 and an axial distance between each pair of protrusions in relation to flap V2 of envelope V. As discharge rollers 102 rotate, envelope V is discharged in a direction of arrow D2, and thus, envelope main body V1 is discharged first, and flap V2 is discharged subsequently. Flap V2 has a shape in which its width (a length in a direction that is parallel with folding line V3 and is perpendicular to the direction of arrow D2) becomes smaller in a rearward direction with respect to the direction of arrow D2. Thus, edge portion E of flap V2 of envelope V shown in FIG. 3 is an example of "a trailing end having a shape in which a width becomes smaller in a rearward direction with respect to a direction of discharge."

Region V20 is a portion of flap V2 where a widthwise dimension is equal to or larger than L0. Region V21 is a portion of flap V2 where a widthwise dimension is smaller than L0 and is equal to or larger than L1. Region V22 is a portion of flap V2 where a widthwise dimension is smaller than L1 and is equal to or larger than L2. Region V23 is a portion of flap V2 where a widthwise dimension is smaller than L2 and is equal to or larger than L3. Region V24 is a portion of flap V2 where a widthwise dimension is smaller than L3.

Thus, when discharge rollers 102 are in contact with region V20 of flap V2, discharge rollers 102 function to discharge envelope V in the direction of arrow D2. However, discharge rollers 102 do not contact regions V21-V24, which are positioned on a back side of region V20 with respect to the direction of arrow D2 (direction of discharge). Therefore, once region V20 has passed discharge rollers 102, discharge rollers 102 no longer function to discharge envelope V. At this time, as shown in FIG. 2, flap V2 moves around folding line V3 as an axis, to incline in a direction of arrow D3 to a position indicated by broken lines.

In flap V2 that has moved to the position indicated by the broken lines in FIG. 2, region V21 shown in FIG. 8, which has a widthwise dimension smaller than L0 and equal to or larger than L1, comes into contact with first protrusions 111*a* and 111*b* (see FIG. 7), which are spaced apart from each other by distance L1, and thus, region V21 is conveyed by first protrusions 111*a* and 111*b* in the direction of arrow D2.

Also, region V22 of flap V2, which has a widthwise dimension smaller than L1 and equal to or larger than L2, comes into contact with second protrusions 112*a* and 112*b*, which are spaced apart from each other by distance L2, and thus, region V22 is conveyed by second protrusions 112*a* and 112*b* in the direction of arrow D2.

Similarly, region V23 of flap V2, which has a widthwise dimension smaller than L2 and equal to or larger than L3, comes into contact with third protrusions 113*a* and 113*b*, which are spaced apart from each other by distance L3, and thus, region V23 is conveyed by third protrusions 113*a* and 113*b* in the direction of arrow D2.

Then, region V24 of flap V2 comes into contact with fourth protrusion 114, and is conveyed in the direction of arrow D2.

1-3-3. Hook Portion of Protrusion

Next, explanation will be given of an operation of a hook portion of a protrusion.

Figure 9A:
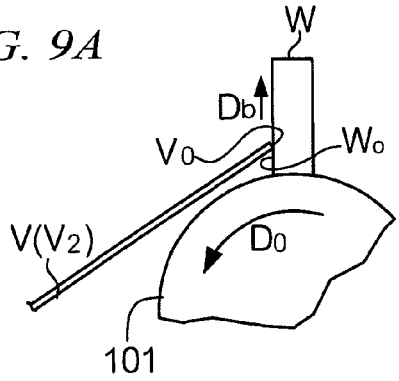
FIGS. 9A-9C are drawings for explaining an operation of a protrusion without a hook portion provided thereon.
Figure 9B:
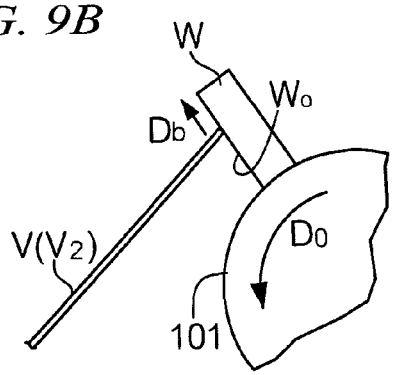
Figure 9C:
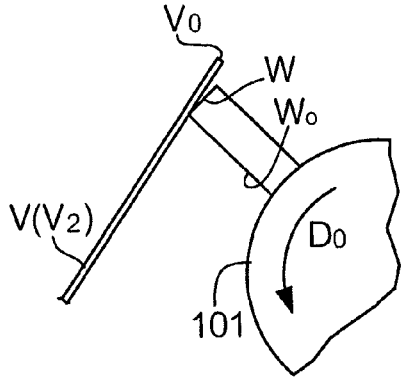

FIGS. 9A-9C are drawings for explaining an operation of a protrusion without a hook portion provided thereon. The above-described second protrusions 112 and fourth protrusion 114 are protrusions without a hook portion provided thereon. A protrusion without a hook portion includes straight flat plate W extending radially, i.e., perpendicularly to the direction of axis O (Z-axis direction) of discharge rod 101. Straight flat plate W is provided on a circumferential surface of discharge rod 101, and is caused to rotate together with rotation of discharge rod 101 in the direction of arrow D0. As shown in FIG. 9A, surface W0 of straight flat plate W facing in the direction of arrow D0 comes into contact with trailing end V0 of envelope V (more specifically, flap V2 of envelope V), and pushes envelope V along the direction of rotation of discharge rod 101. At this time, depending on an inclination of envelope V relative to surface W0, trailing end V0 of envelope V may be caused to slide, owing to inertia acting on envelope V, in a direction of arrow Db or a direction along surface W0 and away from discharge rod 101, as shown in FIG. 9B. In such a case, if trailing end V0 moves beyond a length of extension of straight flat plate W, as shown in FIG. 9C, surface W0 of straight flat plate W disengages from trailing end V0, so that the protrusion does not function to discharge envelope V.

Figure 10A:
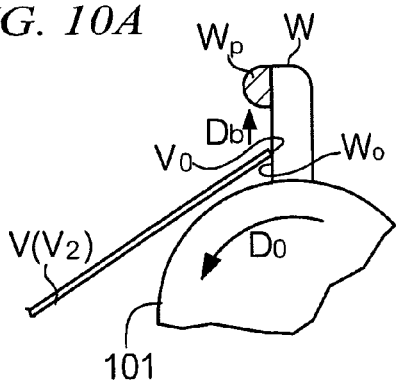
FIGS. 10A-10C are drawings for explaining an operation of a protrusion with a hook portion provided thereon.
Figure 10B:
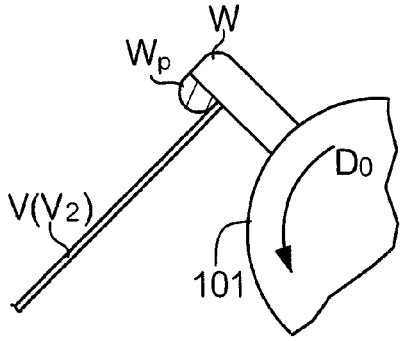
Figure 10C:
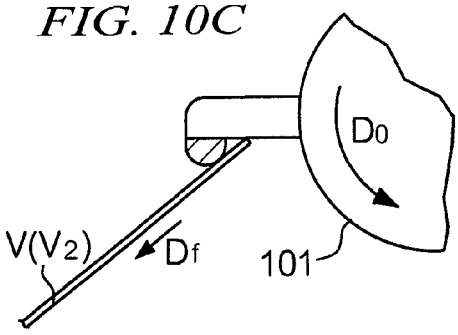

On the other hand, FIGS. 10A-10C are drawings for explaining an operation of a protrusion with a hook portion provided thereon. The above-described first protrusions 111 and third protrusions 113 each are protrusions with a hook portion provided thereon. Each of these protrusions includes straight flat plate W extending radially, i.e., perpendicularly to the direction of axis O (Z-axis direction) of discharge rod 101, and hook portion Wp. Hook portion Wp is a member projecting from a tip portion of straight flat plate W in the direction of rotation of discharge rod 101 (in a frontward direction with respect to the direction of arrow D0) perpendicularly to straight flat plate W. As shown in FIG. 10A, when surface W0, which faces in the direction of arrow D0, of straight flat plate W of a protrusion comes into contact with trailing end V0 of envelope V to push envelope V in the direction of rotation of discharge rod 101, trailing end V0 may be caused to slide in the direction of arrow Db. However, as shown in FIG. 10B, the sliding trailing end V0 comes to abut hook portion Wp, and thus, does not move further in the direction away from discharge rod 101. Then, upon further rotation of discharge rod 101 in the direction of arrow D0, straight flat plate W of the protrusion pushes envelope V, thereby to discharge envelope V in a direction of arrow Df, as shown in FIG. 10C.

2. Modifications

An exemplary embodiment has been described in the foregoing. The exemplary embodiment may be modified as described below. The following modifications may be used in any combination.

2-1. Image-Forming Unit

In the above-described exemplary embodiment, image-forming unit 500 forms an image on a surface of a recording medium by an electrophotography process using a developer. However, formation of an image on a recording medium may be carried out by another process. For example, an image may be formed by ink jet technique.

2-2. Protrusions (1) In the above-described exemplary embodiment, the protrusions extending from discharge rod 101 include, in a section of discharge rod 101 sandwiched between discharge rollers 102*a* and 102*b*, four types of protrusion, i.e., first protrusions 111, second protrusions 112, third protrusions 113, and fourth protrusion 114, respectively corresponding to four different positions in the direction of rotation of discharge rod 101. However, the protrusions may include fewer than four types of protrusion or more than four types of protrusion.

(2) In the above-described exemplary embodiment, of the four types of protrusions, first protrusions 111 and third protrusions are provided with a hook portion. However, it is possible that at least one type of protrusion is provided with a hook portion.

(3) It is possible that, of the multiple types of protrusion, only two types of protrusion positioned symmetrically about the axis of discharge rod 101 are provided with a hook portion. In this way, in a case where discharge rod 101 is molded integrally with the protrusions by injection of resin into a mold, removal of discharge rod 101 from the mold can be made easier, as compared to a case where three or more types of protrusion are provided with a hook portion. It is to be noted that discharge rod 101 does not have to be molded integrally with the protrusions, and the protrusions may be attached on a circumferential surface of molded discharge rod 101 by means of an adhesive, for example.

(4) The positions of the protrusions in the axial direction (Z-axis direction) may be the same. Namely, the distance in the axial direction between each pair of protrusions only need be smaller than the distance between the pair of discharge rollers.

(5) It is to be noted that, in the above-described exemplary embodiment, the protrusions are divided into groups based on the direction in which each protrusion extends away from the axis, and each group is composed of a pair of protrusions that are spaced apart from each other in the axial direction, except for the group composed of fourth protrusion 114. Of these groups, those composed of a pair of protrusions are arranged such that the distances between the pairs of protrusions provided on discharge rod 101 become progressively smaller in the rearward direction with respect to the direction of rotation of discharge rod 101 (L1→L2→L3).

As discharge rod 101 rotates, a trailing end of a recording medium comes into contact with first protrusions 111 that are spaced apart from each other by distance L1, and is pushed by first protrusions 111 toward stacking unit 300. Since the trailing end of the recording medium has a width that becomes smaller in the rearward direction relative to the direction of discharge, after being pushed toward stacking unit 300, the recording medium will have a width smaller than L1 at a portion that is closest to discharge rod 101. At this time, since the protrusions are arranged in the order described in the foregoing, second protrusions 112 spaced apart from each other by distance L2, which is smaller than L1, come into contact with the trailing end of the recording medium subsequently to first protrusions 111. Thus, even when the width of the trailing end of the recording medium is smaller than L1, second protrusions 112 push the trailing end of the recording medium in the direction of discharge.

Similarly, subsequently to second protrusions 112, third protrusions 113 spaced apart from each other by distance L3, which is smaller than L2, come into contact with the trailing end of the recording medium, and further, subsequently to third protrusions 113, fourth protrusion 114, which is provided alone in the axial direction, comes into contact with the trailing end of the recording medium. Thus, the distances between the pairs of protrusions for pushing a trailing end of a recording medium are adapted to become smaller as discharge rod 101 rotates, and therefore, the protrusions sequentially push a trailing end of a recording medium even in a case where the width of the trailing end becomes smaller as the discharge of the recording medium progresses.

(6) The protrusions do not have to include a group composed of a pair of protrusions. Namely, it is possible that multiple protrusions are provided in a section of discharge rod 101 sandwiched between discharge rollers 102*a* and 102*b* such that the protrusions protrude respectively from at least two different positions in the axial direction. Since the discharge mechanism of an exemplary embodiment of the present invention has a configuration in which the protrusions protruding from at least two different positions in the axial direction are adapted to push a trailing end of a recording medium, it is possible to suppress rotational movement of a recording medium around a contact point between the recording medium and one of the protrusions.

(7) In the above-described exemplary embodiment, a hook portion is a member projecting from a tip portion of a protrusion in the direction of rotation of discharge rod 101. However, a hook portion may project from a portion of a protrusion other than a tip portion. Also, an angle between a direction of extension of a hook portion and a direction of extension of a protrusion is not limited to a right angle, and may be an obtuse angle or an acute angle. Moreover, a direction of extension of a protrusion does not have to pass through axis O of discharge rod 101, and may be curved.

Figure 11A:
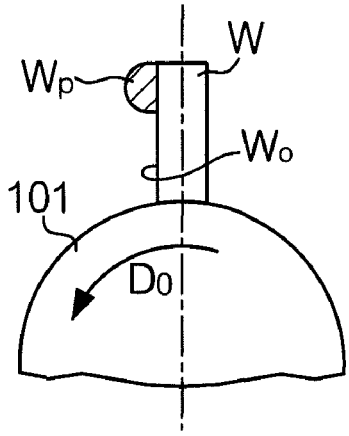
FIGS. 11A-11F show modifications of a protrusion having a hook portion.
Figure 11B:
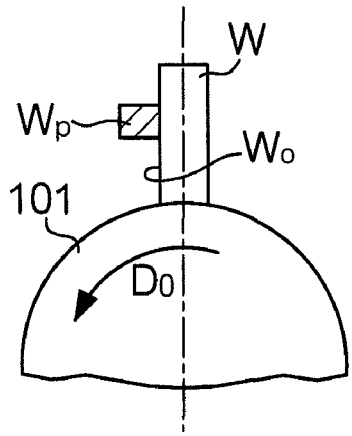

FIGS. 11A-11F show modifications of a protrusion having a hook portion. In the above-described exemplary embodiment, a protrusion having a hook portion has the shape shown in FIG. 11A. Namely, a protrusion in the above-described exemplary embodiment has a shape in which hook portion Wp projects in the direction of rotation of discharge rod 101 (in a frontward direction with respect to the direction of arrow D0) from a tip portion of straight flat plate W extending in a direction passing through axis O (not shown in this drawing) of discharge rod 101. However, as shown in FIG. 11B, a protrusion may have hook portion Wp projecting in the direction of rotation of discharge rod 101 from an intermediate position in the direction of extension of straight flat plate W (i.e., from a position that is neither a tip nor a base).

Figure 11C:
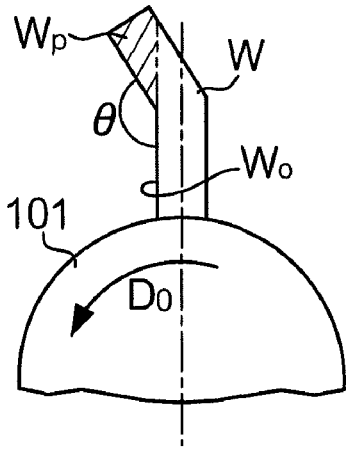
Figure 11D:
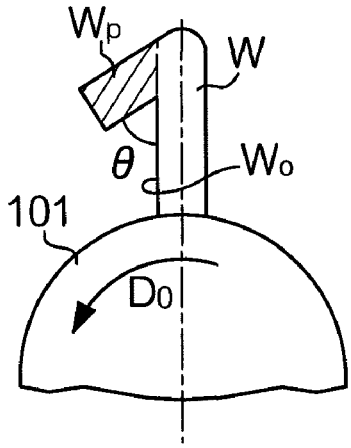

Also, angle θ between hook portion Wp and straight flat plate W (an angle between a surface of hook portion Wp facing axis O of discharge rod 101 and surface W0 of straight flat plate W facing in the direction of rotation of discharge rod 101) preferably is an acute angle as shown in FIG. 11D, but may be an obtuse angle as shown in FIG. 11C, if a frictional force acting between straight flat plate W and a recording medium is sufficiently large. Namely, it is only necessary that a protrusion has a configuration that in which hook portion Wp holds a trailing end of a recording medium that is pushed in the direction of discharge by surface W0 facing in the direction of rotation of discharge rod 101, thereby to prevent the trailing end from moving beyond an extension of straight flat plate W.

Figure 11E:
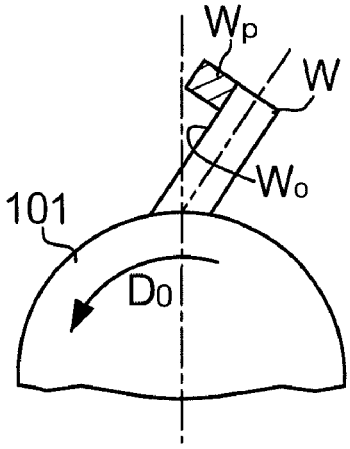
Figure 11F:
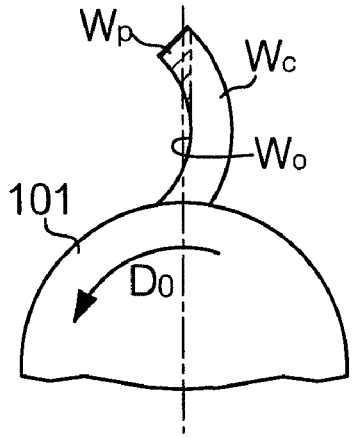

Further, as shown in FIG. 11E, a line drawn in the direction of extension of straight flat plate W does not have to pass through axis O (not shown in this drawing) of discharge rod 101. Furthermore, as shown in FIG. 11F, a protrusion may include curved flat plate Wc instead of straight flat plate W. In this case, curved flat plate Wc has concave surface W0 facing in the direction of rotation of discharge rod 101, and this surface W0 and hook portion Wp provided on the tip portion of curved flat plate We serve to push a trailing end of a recording medium in the direction of rotation, while holding the trailing end.

2-3. Discharge Rod

In the above-described exemplary embodiment, discharge rollers 102 and the protrusions are provided on common discharge rod 101. However, it is only necessary that discharge rollers 102 and the protrusions are adapted to be able to rotate about axis O, which is an axis extending in Z-axis direction. Therefore, discharge rollers 102 and the protrusions may be provided on different rods. For example, in a case where discharge rollers 102 are provided on one rod and the protrusions are provided on another, discharge unit 100 may include a transmission mechanism that engages both of gears provided on outer circumferences of these rods, so that discharge rollers 102 and the protrusions are caused to rotate about common axis O. In this case, discharge unit 100 including the transmission mechanism may be configured such that the rotation speed of discharge rollers 102 is different from that of the protrusions.

2-4. Others

The shape of flap V2 shown in FIG. 3 is a triangle (isosceles triangle) including folding line V3 as a base. However, the shape of flap V2 may be a trapezoid including folding line V3 as a longer one of the parallel sides. For example, flap V2 may have a shape that does not include region V24 shown in FIG. 8. Thus, the above-described envelope V is an example of a recording medium with a trailing end having a shape in which a width becomes smaller in a rearward direction with respect to a direction of discharge.

The foregoing description of the embodiments of the present invention is provided for the purposes of illustration and description. It is not intended to be exhaustive or to limit the invention to the precise forms disclosed. Obviously, many modifications and variations will be apparent to practitioners skilled in the art. The embodiments were chosen and described to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A discharge mechanism comprising:

a rotation shaft;

a pair of roll members disposed on the rotation shaft at different positions in an axial direction; and a protrusion that protrudes from a section of the rotation shaft sandwiched between the pair of roll members, wherein a distance from a center of the rotation shaft to a tip of the protrusion is smaller than a radius of each of the pair of roll members, and the protrusion includes a projecting member that projects in a direction of rotation of the rotation shaft.

2. The discharge mechanism according to claim 1, wherein the projecting member projects at an angle equal to or smaller than 90 degrees relative to the protrusion.

3. The discharge mechanism according to claim 1, wherein a plurality of said protrusions are provided in the section of the rotation shaft, such that the protrusions protrude from at least two different positions in the axial direction.

4. The discharge mechanism according to claim 2, wherein a plurality of said protrusions are provided in the section of the rotation shaft, such that the protrusions protrude from at least two different positions in the axial direction.

5. The discharge mechanism according to claim 3, wherein the protrusions are arranged at positions that accord with a shape of a trailing end of a recording medium, and, when the rotation shaft is caused to rotate in the direction of rotation, come to be in contact with the trailing end to discharge the recording medium.

6. The discharge mechanism according to claim 4, wherein the protrusions are arranged at positions that accord with a shape of a trailing end of a recording medium, and, when the rotation shaft is caused to rotate in the direction of rotation, come to be in contact with the trailing end to discharge the recording medium.

7. An image-forming device comprising:

an image-forming unit that forms an image on a recording medium; and a discharge mechanism according to claim 1 that discharges the recording medium on which an image has been formed by the image-forming unit.

* * * * *